US005669779A

United States Patent [19]

Galloway et al.

[11] Patent Number: 5,669,779

[45] Date of Patent: Sep. 23, 1997

[54] METHOD AND APPARATUS FOR CONNECTING TO A CIRCUIT IN A JACK WITHOUT INTERRUPTING THE CIRCUIT

[75] Inventors: George G. Galloway, Graford; John N. Moss, Weatherford, both of Tex.

[73] Assignee: Industrial Technology, Inc., Mineral Wells, Tex.

[21] Appl. No.: 533,686

[22] Filed: Sep. 26, 1995

[51] Int. Cl.[6] ..... H01R 29/00

[52] U.S. Cl. ..... 439/188; 439/669; 29/854

[58] Field of Search ..... 439/188, 669, 439/668; 29/854

[56] References Cited

U.S. PATENT DOCUMENTS

| | | | |
|---|---|---|---|
| 1,808,902 | 6/1931 | Mueller | 439/188 |
| 3,419,684 | 12/1968 | Lord et al. | 200/6 B |
| 3,678,440 | 7/1972 | Gilsdorf | 439/669 |
| 4,110,696 | 8/1978 | Meeks | 439/669 |
| 4,295,694 | 10/1981 | Manning | 439/188 |
| 4,368,941 | 1/1983 | Martin | 439/669 |
| 4,861,132 | 8/1989 | Moulin | 439/669 |

*Primary Examiner*—Gary F. Paumen
*Assistant Examiner*—Tho Dac Ta
*Attorney, Agent, or Firm*—Geoffrey A. Mantooth

[57] ABSTRACT

In a jack that receives a "make with break" plug or jack, there is provided a "make without break" plug. The jack has a circuit with a set of contacts that are normally closed. The circuit is opened by displacing one of the contacts out of contact with the other contact. With the make without break plug, only a minimal displacement of the jack contacts occurs. The plug minimizes the displacement of the jack contacts by limiting the physical size of the plug. A preferred embodiment utilizes a reduced radius to form a notch in the plug. This notch receives the jack contacts with little or no displacement of these contacts. Another technique used to minimize the displacement of the jack contacts is to limit the amount of force exerted by the plug against the jack contacts. The plug itself is provided with displaceable and pliant contacts. Less force is required to displace the plug contacts than is required to displace the jack contacts.

14 Claims, 6 Drawing Sheets

METHOD AND APPARATUS FOR CONNECTING TO A CIRCUIT IN A JACK WITHOUT INTERRUPTING THE CIRCUIT

FIELD OF THE INVENTION

The present invention relates to methods and apparatuses for connecting to electrical circuits, such as digital telephone circuits, in a nondisruptive manner.

BACKGROUND OF THE INVENTION

There is frequently a need to connect to an existing electrical circuit for monitoring and test purposes. If the circuit is in service, or is being utilized, then typically the connection must be made without interrupting that circuit. For example, digital telephone circuits, which carry large amounts of information, should not be interrupted. Interruptions of such circuits could wreck havoc with customers using the circuits. Thus, connection to a digital telephone circuit must be made without interrupting the circuit.

Some circuits can be directly connected to by way of physical contact with the circuit conductors. If the conductors are exposed, metallic clips can be used. Unfortunately, metallic clips cannot be used in many applications. For example, telephone circuits are routed through bays in central offices, or at private branch exchanges. These bays typically contain large numbers of circuits that are physically spaced closer together. The use of metal clips carries the risk of shoring the circuit to ground or to another circuit, thereby causing interruption of one or more circuits.

An alternative to metallic clips are insulation piercing clips that are placed on a circuit wires themselves. As the name suggests, the clips pierce the insulation of the wire, presenting the risk of insulation degradation. In addition, the clips may damage the wire conductor. For these reasons, insulation piercing clips are prohibited at many installations.

In addition, physical access to many circuits may be limited. For example, the wires of a circuit may be located behind a panel or wall. Also, the wires may be bundled with the wires of other circuits, making identification of the circuit difficult and time consuming.

Many circuits are accessible by way of a jack. The jack is easy to access and typically is labeled to permit identification of the circuit. The jack receives a plug, which plug can be removed. When the plug is not in the jack, a first circuit is typically formed inside of the jack. The first circuit is formed by way of normally closed switch contacts. When the plug is inserted into the jack, the plug breaks the first circuit and creates a second circuit with some of the switch contacts. Thus, the plug performs a "make with break" function. The plug and jack arrangement then do not allow connecting to the circuit unless the circuit is interrupted.

SUMMARY OF THE INVENTION

It is an object of the present invention to provide an improved method and apparatus for connecting to a circuit by way of a jack, without interrupting the circuit.

It is a further object of the present invention to provide a method and apparatus for connecting to a circuit by way of a jack, without interrupting the circuit, using a plug that is insertable into the jack.

The present invention utilizes a "make without break" plug so as to connect to a circuit in a jack, without interrupting that circuit.

In one aspect of the invention, a method of connecting the circuit is provided. The circuit is in a jack, with the jack having a port that is adjacent to the circuit. The circuit includes first and second switch contacts that are normally closed together to provide continuity of the circuit. The circuit is opened by displacing the first switch contact out of contact with the second switch contact. A conductor is inserted into the port of the jack. The conductor contacts the first switch contact. The displacement of the first switch contact is limited during contact with the conductor so as to maintain the circuit continuity through the first and second switch contact.

In accordance with one aspect of the method of the present invention, the conductor is provided with at least one surface that, when it contacts the first switch contact, limits the displacement of the first switch contact so as to maintain circuit continuity through the first and second switch contacts. The conductor is rotated about a longitudinal axis so as to align the conductor surface with the first switch contact. The alignment is accomplished before the first switch contact contacts the conductor.

In accordance with another aspect of the method the present invention, the conductor has the first conductor surface. The conductor also has a second conductor surface that displaces the first switch contact out of contact with the second switch contact so as to open the circuit, when the second conductor surface contacts the first switch contact. The conductor is rotated about a longitudinal axis so as to align the second conductor surface to make contact with the first switch contact, wherein the circuit is opened. In this manner, the circuit can be selectively opened and closed by rotating the conductor.

In accordance with another aspect of the present invention, a plug is provided for insertion into a jack. The jack has a set of normally closed contacts. The plug includes a sleeve that has an outside diameter that is formed by a sleeve radius. The sleeve is structured and arranged to be received by a port in the jack. This sleeve has an end. A conductor extends from the end of the sleeve. The conductor is offset from a longitudinal axis of the sleeve so as to form a notch that extends along the length of the conductor to the sleeve.

In accordance with one aspect of the plug of the present invention, the conductor has a conductor end and a sleeve end. The conductor end is located away from the sleeve. The conductor end is flat. By providing a flat end to the conductor, insertion of the conductor in its proper orientation with respect to the switch contacts is assured.

In accordance with another aspect of the present invention a plug is provided for insertion into a jack. The plug has a sleeve with an outside diameter that is formed by a sleeve radius. The sleeve is structured and arranged to be received by a port in the jack. The sleeve has an end. A conductor has a base and a tip. The tip extends from the end of the sleeve. The conductor is resilient so as to deflect relative to the longitudinal axis of the sleeve.

In accordance with still another aspect of the present invention, an apparatus for connecting to a circuit is provided. The apparatus includes a jack. The jack has a port that is adjacent to a circuit. The circuit includes first and second switch contacts that are normally closed together. The circuit is opened by displacing the first switch contact out of contact with the second switch contact. The apparatus also has a plug. The plug includes a sleeve that is received by the jack port. The plug also includes a conductor that extends from the sleeve. The conductor contacts the first switch contact while limiting the displacement of the first switch contact so as to maintain the circuit continuity through the first and second switch contacts.

The displacement of the switch contact is limited in several ways. In one aspect of the invention, the plug conductor includes a first surface. The first surface has a first radius with respect to a longitudinal axis of the sleeve. The first surface extends for a length of the conductor, wherein when the first surface contacts the first switch contact, circuit continuity through the first and second switch contacts is maintained.

In another aspect of the invention, the first switch has a first pliancy. The plug conductor has second pliancy such that the plug conductor displaces relative to a longitudinal axis of the sleeve, with the second pliancy being greater than the first pliancy so as to limit the displacement of the first switch contact.

DESCRIPTION OF THE PREFERRED EMBODIMENTS

The present invention allows a technician to connect to an electrical circuit by way of a plug inserted into a jack. The jack receives a conventional plug that breaks the circuit while making a new circuit. The present invention provides a new plug that is inserted into the jack and that makes contact with the existing jack circuit, without interrupting or breaking that circuit.

The plug accomplishes this by minimizing the displacement of the contacts inside of the jack when the plug is inserted therein. A conventional plug displaces the switch contacts inside of the jack when the plug is inserted into the jack. With the conventional plug, the switch contacts are displaced a sufficient amount so as to break the existing circuit. With the plug of the present invention, only a minimal displacement of the jack contacts occurs. This minimal displacement is sufficient to provide electrical contact between the jack contacts and the plug and yet not break the circuit.

The plug of the present invention minimizes the displacement of the jack contacts by limiting the physical size of the plug. As shown below, the preferred embodiment utilizes a reduced radius to form a notch in the plug. This notch receives the jack contacts with little or no displacement of these contacts.

Another technique used to minimize the displacement of the jack contacts is to limit the amount of force exerted by the plug against the jack contacts. The plug itself is provided with displaceable and pliant contacts. Less force is required to displace the plug contacts than is required to displace the jack contacts. This is because the plug contacts are more pliant than are the jack contacts. Thus, when the plug is inserted into the jack, electrical contact is made between the plug contact and the jack contacts.

In the description below, the present invention will be described in the context of a DSX (Digital Cross-connect) jack. However, the present invention can be used in a variety of other situations where plugs are normally used to make and break circuits. For example, telephone customers may have a hardware panel (referred to as an NIU panel), which panel has a jack. The plug of the present invention can be utilized for such a jack. Also, in the description that follows, the plug has tip and ring conductors. The plug need not have two conductors or contacts but may merely have one conductor.

Figure 1:
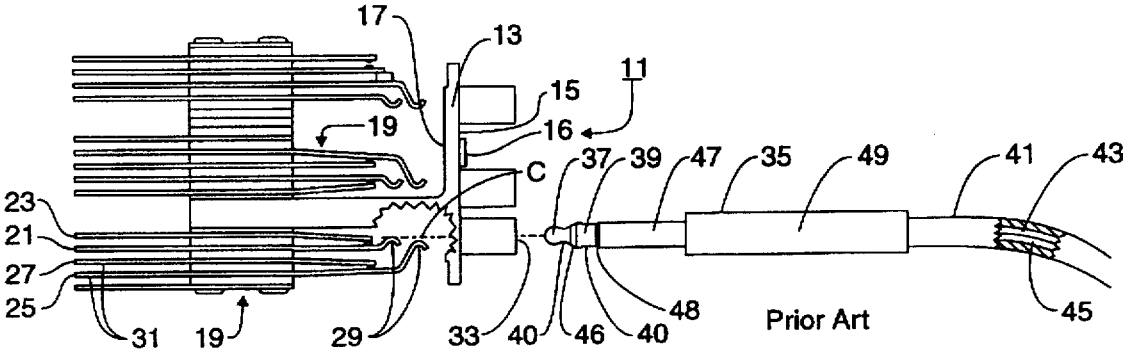
FIGS. 1–3 are side, partially cut away, views of a jack, showing the steps in the insertion of a prior art plug, wherein the circuit in the jack is broken by the plug.
Figure 2:
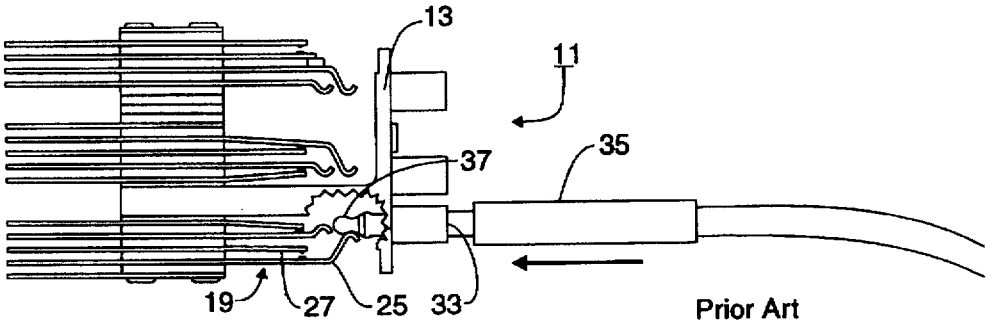
Figure 3:
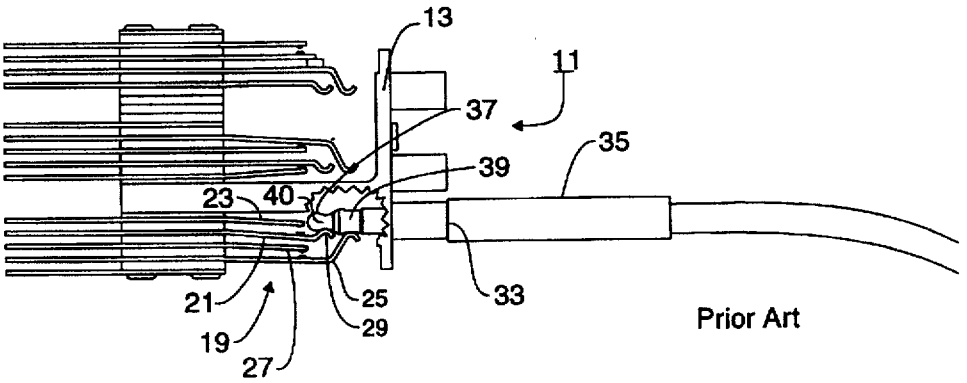

Referring now to FIGS. 1–3, a typical jack and a conventional plug will be described.

FIG. 1 shows a side view of a portion of a jack 11, which is conventional and commercially available. The jack 11 can be used in a DSX bay. The jack 11 has a wall 13, which wall forms a front side 15 of the bay and a back side 17. The front side 15 of the jack is readily accessible to a human, such as a telephone technician. The back side 17 has switches 19. Each switch 19 has a circuit (such as a DS1 circuit, which is a standard digital telephone carrier) routed therethrough. Each switch 19 has a tip portion and a ring portion. The tip portion of the switch has a first tip contact 21 and second tip contact 23. These two contacts 21, 23 form leaf contacts near the back side 17 of the wall 13, where they make electrical and physical contact with each other. Likewise, the ring portion of the circuit has a first ring contact 25 and a second ring contact 27. The ends 29 of the first tip contact 21 and the first ring contact 25 that are nearest to the wall 13 are curved. These ends 29 intersect a path that is traversed by a plug 35. The ends 31 of the contacts that are furthest away from the wall 13 are connected to tip and ring wires (not shown).

The wall 13 of the jack 11 contains an opening 33 or port for each switch 19. The plug 35 is inserted into the port 33 for rerouting the circuit.

The plug has a tip conductor 37 and a ring conductor 39. Both conductors are metallic so as to make electrical connection to metallic contacts 21, 25. Thus, the first tip contact with the tip conductor 37 of the plug, and the first ring contact 25 makes contact with the ring conductor 39 of the plug. The tip and ring conductors 37, 39 are each cylindrical. Each conductor 37, 39 has a circumferential groove 40 for receiving the rounded end 29 of a respective contact 21, 25.

The tip and ring conductors 37, 39 are connected respectively to tip and ring wires 43, 45 in a cable 41. The tip and ring conductors are electrically separated from one another by an insulating ring 46. There is also provided a conductive sleeve 47 which is used for test purposes. In addition, the sleeve 47 makes an interference fit with the port 33 so as to secure the plug to the jack. The sleeve 47 also aligns the plug within the switch. The sleeve 47 is electrically separated from the ring conductor 39 by an insulating ring 48. An insulating handle 49 is located between the exposed conductors 37, 39, 47 and the cable 41. The plug 35 has a barrel portion that is made up of the tip conductor 37, the ring conductor 39 and the sleeve 47. The barrel is fixedly coupled to the handle 49. The plug and cable assembly is conventional and commercially available.

When the plug 35 is inserted into the port 33, as shown in FIGS. 2 and 3, the plug 35 opens the switch 19 and breaks the original circuit. Specifically, as shown in FIG. 2, the tip conductor 37 contacts the first ring contact 25. The radius of the tip conductor 37 causes the first ring contact 25 to displace away from and break contact with the second ring contact 27. As shown in FIG. 3, as the plug 35 continues to be pushed into the port 33, the first ring contact 25 continues to be displaced from the second ring contact 27 by the radius of the ring conductor 39. The tip conductor 37 contacts the first tip contact 21 and displaces the first tip contact such that contact is broken between the first and second tip contacts 21, 23. The plug is secured in place by the rounded ends 29 of the contacts being located in the circumferential grooves 40 of the plug. The grooves have a radius that is large enough so as to maintain the displacement of the first tip and ring contacts 21, 25 away from the second tip and ring contacts 23, 27.

Thus, the plug 35 breaks the circuit by displacing some of the contacts in the switch 19.

Figure 4:
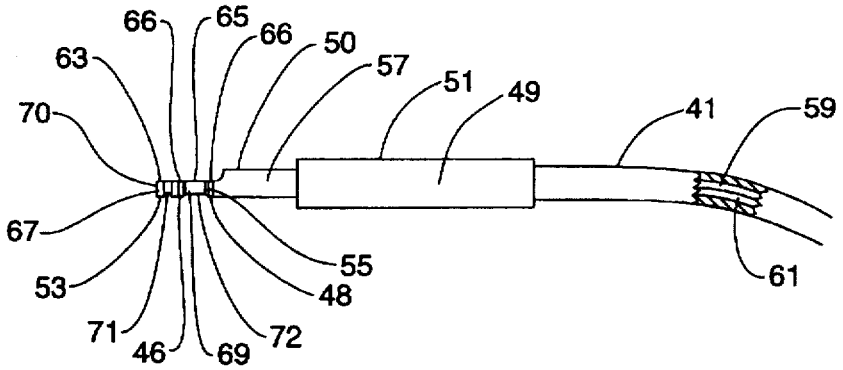
FIG. 4 is a side view of the plug of the present invention, in accordance with a preferred embodiment.
Figure 4A:
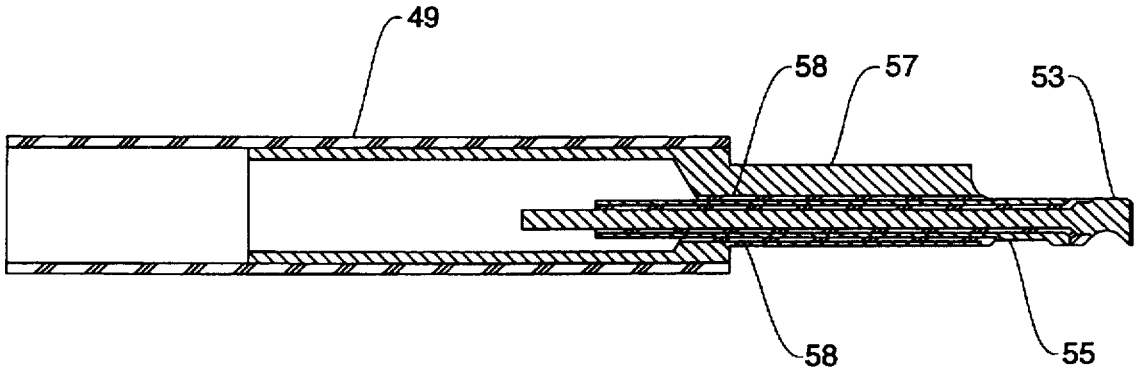
FIG. 4A is a longitudinal cross-sectional view of the plug of FIG. 4.

Referring to FIGS. 4 and 4A, the plug 51 of the present invention is shown. The plug 51 is similar to the plug 35 of FIG. 1 in that it has a tip conductor 53, a ring conductor 55, and a conductive sleeve 57. The plug 51 may have an insulating handle 49, that is located between the exposed conductors 53, 55, 57 and a cable 41. The tip conductor 53 is connected to a tip wire 59 in the cable 41, while the ring conductor 55 is connected to a ring wire 61. Also, the plug 51 has a barrel portion 50 that is made up of the tip conductor 53, the ring conductor 55, and the sleeve 57. The barrel portion 50 is fixedly coupled to the handle 49. The conductors 53, 55, 57 are insulated from each other by sleeves 58.

Unlike the plug 35 of FIGS. 1–3, the plug 51 of FIG. 4 has tip and ring conductors 53, 55 with a reduced radius so as not to displace the tip and ring contacts 21, 25 of the jack 11 when the plug is inserted. In the preferred embodiment, the reduced radius is accomplished with flat surfaces 63, 65. Thus, the tip conductor 53 has a cylindrical surface 67 that merges with the flat tip surface 63. The ring conductor 55 has a cylindrical surface 69 that merges with the flat ring surface 65. The cylindrical surfaces 67, 69 and the flat surfaces 63, 65 form approximate semi or half cylinders. The insulating rings 46, 48 also have flat surfaces 66 that are coplanar with the conductor flat surfaces 63, 65.

The tip cylindrical surface 67 has a circumferential groove 71 therein, the purpose of which will be explained hereinafter. The ring cylindrical surface 69 also has a circumferential groove 72.

The flat surfaces 63, 65 of the plug 51 can be made in several ways. A conventional plug can have its tip and ring conductors machined to form to flat surfaces. Preferably however, the tip and ring conductors 53, 55, and the insulating rings 46, 48, are fabricated with the flat surfaces.

The end 70 of the plug is blunt so as to ensure proper orientation of the plug when inserted into the jack. Specifically, the end 70 is a flat surface (see FIG. 12).

Figure 5:
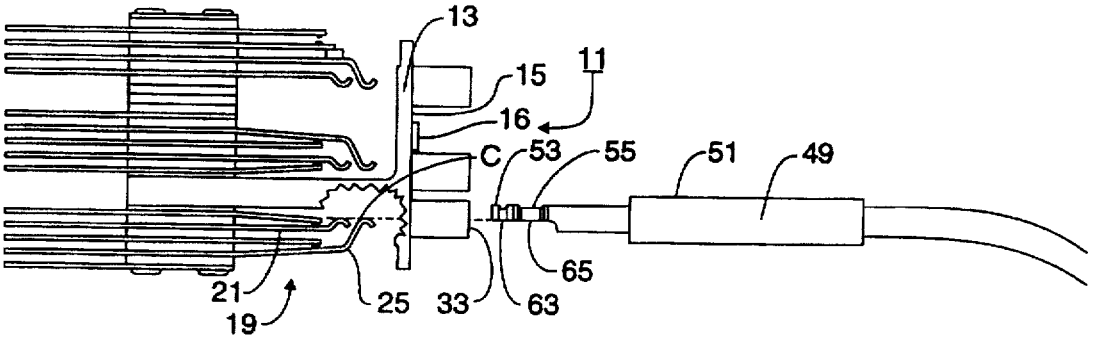
FIGS. 5–7 are side, partially cut away, views of a jack showing the steps in the insertion of the plug of FIG. 4, wherein the circuit in the jack is not broken by the plug.

The operation of the plug 51 will now be described with reference to FIGS. 5–7. When a technician wishes to monitor or test a circuit, the technician holds the plug handle 49 in his hand and aligns the plug 51 with the selected port 33 of a jack 11 as shown in FIG. 5. One aspect of the present invention is that the technician can connect to the circuit from the front side 15 of the jack 11. Thus, the technician is able to take advantage of the labeling 16 and other information on the front side 15 of the jack 11 when locating the desired circuit by way of its port 33.

The plug 51 is oriented so that the flat surfaces 63, 65 will contact the first tip and ring contacts 21, 25 when the plug is inserted. Thus, FIG. 5 shows the flat surfaces 63, 65 facing downwardly for the bottommost port 33.

It is frequently difficult to determine how to orient the flat surfaces relative to the contacts 21, 25. This is because the contacts are not visible from the front side of the bay. Therefore, the technician gently inserts the plug 51 into the port 33 until a resistance to further plug motion is felt. This resistance indicates that the end 70 of the plug has contacted the first ring contact 25. The plug 51 is then rotated about its longitudinal axis until the least resistance to further penetration is felt wherein the flat surfaces 63, 65 are now aligned so as to contact the tip and ring contacts 21, 25 when the plug is pushed in. The technician then pushes in the plug 51.

Figure 6:
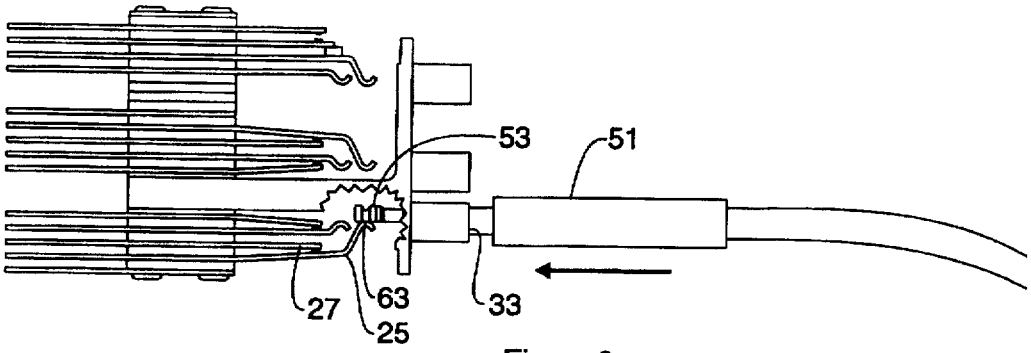

As the plug 51 is pushed in, FIG. 6 shows that the flat surface 63 of the tip conductor 53 contacts the first ring contact 25. However, because of the reduced radius of the flat surface 63 of the tip conductor the switch 19 remains closed and the circuit between the first and second ring contacts 25, 27 is maintained.

Figure 7:
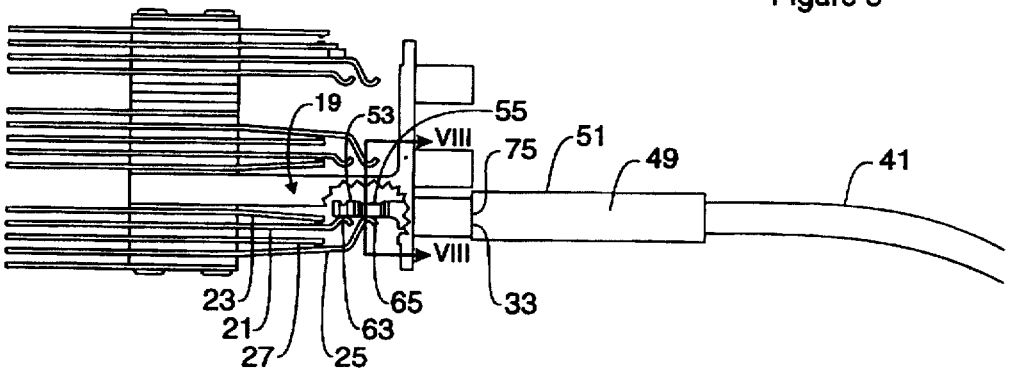

The plug 51 is pushed in all the way, until the handle 49 contacts stop surfaces 75 around the port 33, as shown in FIG. 7. The flat surface 63 of the tip conductor 53 makes electrical contact with the first tip contact 21, while the flat surface 65 of the ring conductor 55 makes electrical contact with the first ring contact 25. The circuit between the first and second tip contacts 21, 23 is not broken. Nor is the circuit between the first and second ring contacts 25, 27 broken. This is because the flat surfaces 63, 65 of the plug do not displace the first tip and ring contacts 21, 25 out of contact with the second tip and ring contacts 23, 27.

Figure 8:
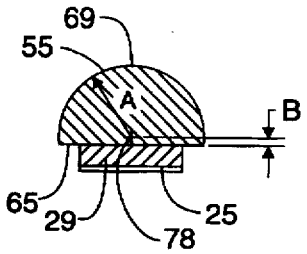
FIG. 8 is a cross-sectional view of the plug and a switch contact, taken through lines VIII—VIII of FIG. 7.

Some displacement of the switch contacts 21, 25 does occur when the plug 51 is inserted into the switch. This is to insure good electrical contact between the plug and the switch contacts. The switch contacts 21, 25 are designed to displace slightly before breaking contact with contacts 23, 27. As the plug 51 is inserted into the switch, it follows a path. Referring back to FIG. 1, the path has a center line C, which corresponds to the center longitudinal axis of the conventional plug 35. The switch contacts 21, 25 intersect this path. The amount of intersection varies from switch manufacturer to switch manufacturer. Some manufacturers cause the switch contacts to intersect not only the plug path, but also the center line of the plug path. Other manufacturers cause the switch contacts to intersect only a shallow portion of the plug path (that does not include the center line). Therefore, the plug 51 is dimensioned to fit what ever particular type of jack that the plug is to be used in. For example, referring to FIG. 8, there is shown a cross-sectional view of the plug 51 in contact with one of the switch contacts 25. The geometric center 78 of the cylindrical surface 69, which center is coaxial to the path center line C, is shown. The distance between the center 78 and the cylindrical surface 69 is a first radius A. The distance between the center 78 and the nearest portion of the flat surface is a second radius B. A certain amount of displacement of the first ring contact (and of the first tip contact) is required before the circuit contacts are broken. The flat side 65 of the plug and the second radius B are dimensioned so as not to displace the contacts 21, 25 beyond the point where the circuit is broken.

Thus, the plug 51 allows the technician to connect to the switch 19 without opening the switch and without interrupting the circuit. Once the plug 51 is inserted, the other end of the cable 41 can be connected to test or monitoring equipment.

Figure 9:
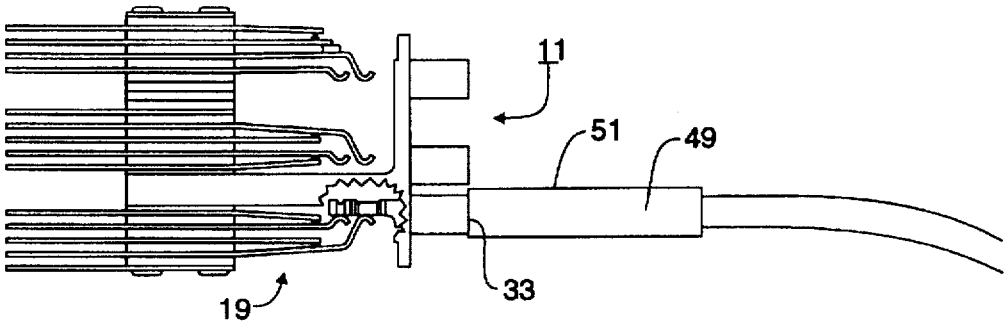
FIGS. 9–11 are side, partially cut away, views of the jack of FIGS. 5–7, showing the steps of how the plug of FIG. 4 can be rotated to break the circuit for rerouting the circuit through the plug.
Figure 10:
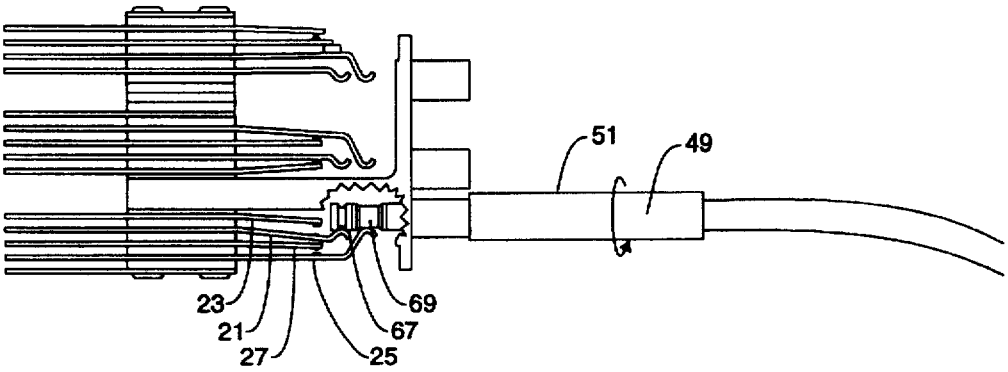

The plug 51 of the present invention provides the capability of selectively opening the switch 19. Referring to FIG. 9, the plug 51 is inserted into the jack 11, as previously shown in FIG. 7. To interrupt the circuit, the technician rotates the plug 51 about its longitudinal axis, as shown in FIG. 10. This is done by gasping the handle 49 and turning. This action increases the diameter of that portion of the plug that is presented to the contacts 21, 25, resulting in a displacement of those contacts. The circuit is interrupted because the first tip contact 21 is displaced away from the second tip contact 23 and the first ring contact 25 is displaced away from the second ring contact 27.

Figure 11:
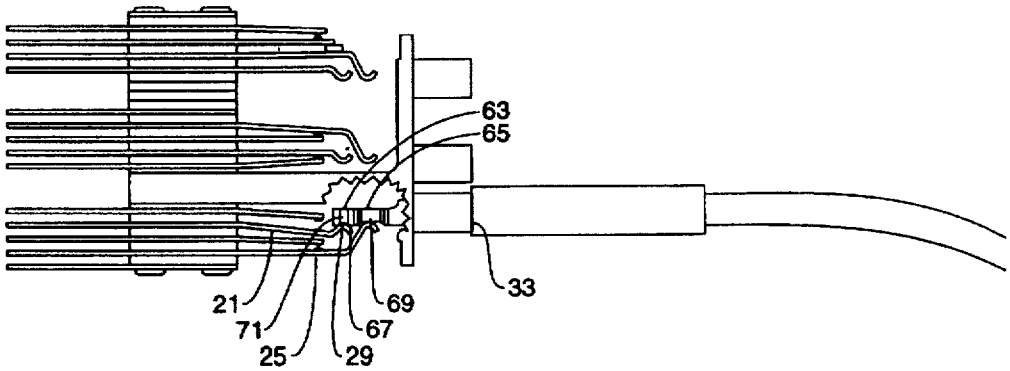

The plug 51 is rotated 180 degrees so that the flat surfaces 63, 65 face opposite of the first tip and ring contacts 21, 25, as shown in FIG. 11. The cylindrical surface 67 of the plug tip conductor makes electrical contact with the first tip contact 21, while the cylindrical surface 69 of the plug ring conductor makes electrical contact with the first ring conductor 25. The groove 71 in the first tip contact receives the rounded end 29 of the first tip contact 21. The cylindrical surface 69 of the first ring conductor can be similarly grooved 72. The groove 71 assists in retaining the plug 51 in place. The first tip and ring contacts 21, 25 remain displaced.

To make the circuit again, the plug 51 is rotated back to its original orientation so as to present the flat surfaces 63, 65 to the contacts 21, 25. The plug 51 is removed from the bay 11 by merely pulling it out from the port 33.

Thus, by providing the plug with a first portion that has a reduced radius and a second portion that has a normal radius, the plug can be manipulated inside of the port to utilize either portion. If the first portion, with the reduced radius, is utilized, then the switch 19 remains closed and the original circuit can be monitored. If the second portion, with the normal radius, is utilized, then the switch 19 is opened and the original circuit is broken. A new circuit can be created.

Figure 12:
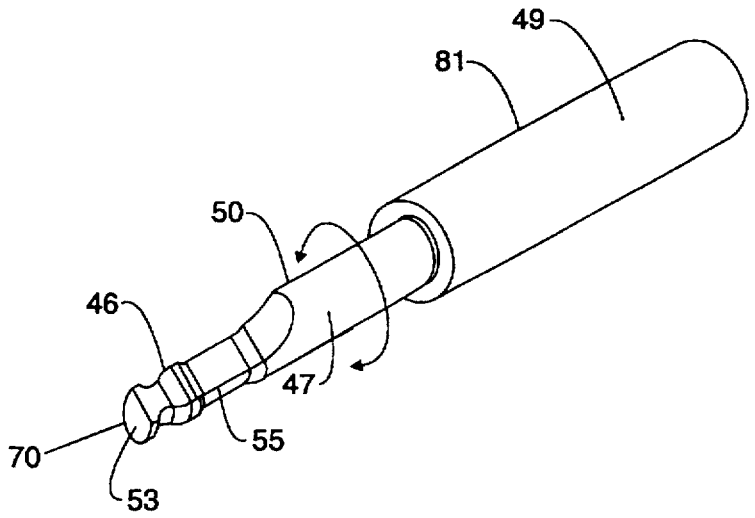
FIG. 12 is an isometric view of the plug of the present invention, in accordance with another embodiment.

The plug 51 has been described above as having its barrel portion 50 fixedly coupled to the handle 49. When the plug is to be oriented to the switch contacts 21, 25, the handle 49 must be manually rotated. Another embodiment of the plug 81 is shown in FIG. 12. In this embodiment the barrel portion 50 rotates with respect to the handle 49. Thus, the plug 81 has self-aligning barrel portion 50. When the plug is inserted into the jack, the technician grasps the handle 49 and pushes the plug in gently. As the tip conductor 53 contacts the first ring contact, the resistance cause the barrel portion 50 to rotate relative to the handle 49 and the switch 19 until the flat surfaces are coplanar with the first ring contact. The tip and ring conductors 53, 55 are connected directly to the wires 59, 61 (see FIG. 4). Stops are provided to prevent over-rotation of the barrel portion 50 relative to the handle 49 and thereby prevent over twisting of the wires. Alternatively, the tip and ring conductors are connected to the wires by way of conducting bearings, which bearings allows full, unstopped rotation of the barrel portion relative to the handle.

The plug of FIG. 4 utilizes reduced physical dimensions that minimize displacement of the jack contacts 21, 25. Specifically, the outside diameter of a portion of a plug is reduced. This can be accomplished with a flat surface as described. However, the reduced dimension surface need not be flat. It could be curved (either convex or concave) or some other shape.

In addition to using reduced physical dimensions of the plug, switch contact displacement can be minimized by limiting the amount of force exerted by the plug on the switch contact. FIGS. 13, 15, 15A, and 16 show various embodiments of plugs of this type.

Figure 13:
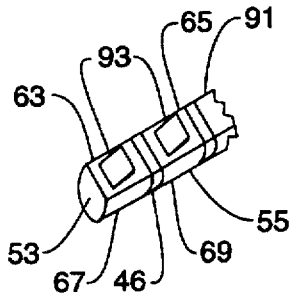
FIG. 13 is an isometric close up view of the tip and ring conductors of a plug, in accordance with still another embodiment, showing movable contacts.

In FIG. 13, there is shown another embodiment of the plug 91. The tip and ring conductors 53, 55 of the plug are each equipped with moving parts in order to reduce the displacement required of the first tip and ring contacts 21, 25 that are located in the switch 19 (see FIG. 7). The flat surface 63, 65 of the tip and ring conductors of the plug are each equipped with a leaf spring contact 93. When the respective leaf spring contact 93 contacts the respective first tip and ring contacts 21, 25, the leaf spring contacts are displaced radially inward slightly, thereby reducing the mount of displacement of the first tip and ring contacts while still obtaining good electrical contact.

Figure 15:
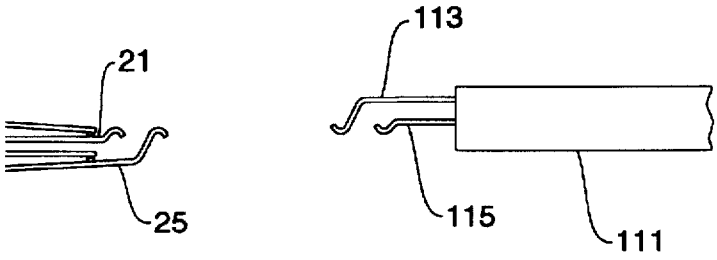
FIG. 15 is a side view of a plug, in accordance with another embodiment, before it is inserted into a jack.
Figure 15A:
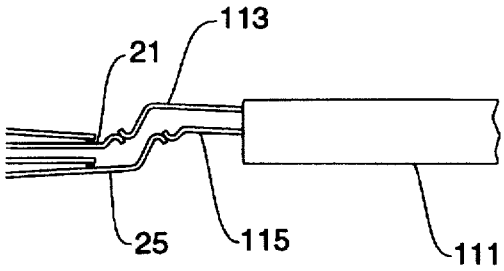
FIG. 15A is a side view of the plug of FIG. 15, shown with the plug inserted into the jack.

In FIG. 15, there is shown a plug 111 that uses leaf springs as contacts. There is tip leaf spring 113 and a ring leaf spring 115. Both contacts 113, 115 are flexible, and both deflect under a smaller force than is required to deflect switch contacts 21, 25.

As the plug 111 is inserted into the jack, the tip leaf contact 113 contacts the tip switch contact 21 and the ring leaf contact 115 contacts the ring switch contact 25. Both leaf contacts 113, 115 deflect upwardly (referring to the orientation of FIG. 15A). Thus, displacement of the switch contacts are minimized and the switch circuit is not broken.

Figure 16:
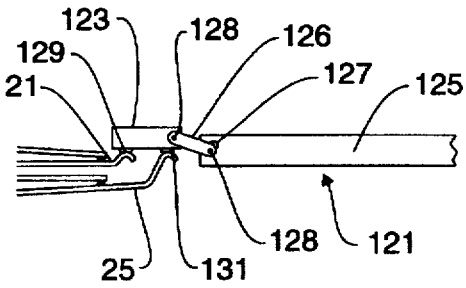
FIG. 16 is a side view of a plug, in accordance with still another embodiment.

FIG. 16 shows still another embodiment of the plug 121. The plug has a member 123 that is pivotally mounted to the sleeve 125 by way of an arm 126. The arm 126 is pivotally coupled 128 to the sleeve 125 and also to the member 123. A spring 127 forces the member 123 downwardly (referring to the orientation of FIG. 16) towards the switch contacts 21, 25. The member has a tip contact 129 and a ring contact 131. When the plug is inserted, the member is deflected up by the switch contacts 21, 25. The mount of force required to deflect the member 123 is less than the amount of force needed to deflect the switch contacts 21. Thus, the switch circuit remains unbroken.

Thus, the plug contacts of FIGS. 13, 15, 15A, and 16 are more pliant than are switch contacts 21, 25. By providing a more pliant plug conductor, the plug presents a "soft" contact to the jack, thereby limiting the displacement of the switch contacts.

Figure 14:
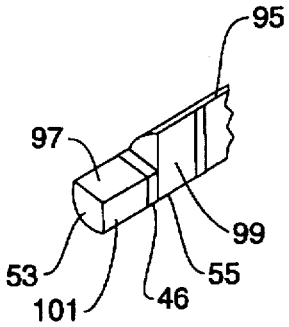
FIG. 14 is an isometric close up view of the tip and ring conductors of a plug, in accordance with still another embodiment.

In FIG. 14, there is shown still another embodiment of the plug 95. In some circumstances, the tip and ring contacts of a switch are not coplanar. Thus, the flat surfaces of the tip and ring conductors can be non-coplanar as well. The flat surface 97 of the tip contact 53 is oriented at 90 degrees with respect to the flat surface 99 of the ring conductor 55. This allows the tip and ring conductors to engage tip and ring switch contacts that are 90 degrees apart. The tip conductor 53 has a flat surface 101 that is coplanar to the flat surface 99 of the ring conductor 55. This is to allow the tip conductor to be inserted past the first ring contact, without displacing the first ring contact.

The foregoing disclosure and the showings made in the drawings are merely illustrative of the principles of this invention and are not to be interpreted in a limiting sense.

We claim:

1. A method of connecting to a circuit in a jack, the jack having a port adjacent to the circuit, the circuit comprising first and second switch contacts that are normally closed together so as to provide continuity of the circuit, the first switch contact being displaceable to first and second displacements relative to the second switch contact, with the circuit being closed when the first switch contact is displaced to the first displacement due to the first switch contact being in contact with the second switch contact, and with the circuit being opened when the first switch contact is displaced to the second displacement due to the first switch contact being out of contact with the second switch contact, comprising the steps of:

a) providing a conductor with at least one surface that, when the one surface contacts the first switch contact, limits the displacement of the first switch contact to the first displacement so as to maintain circuit continuity through the first and second switch contacts;

b) inserting the conductor partially into the port of the jack;

c) rotating the conductor about a longitudinal axis so as to align the one conductor surface with the first switch contact;

d) continuing to insert the conductor fully into the port of the jack and limiting the displacement of the first switch contact to the first displacement during contact with the conductor so as to maintain circuit continuity through the first and second switch contacts.

2. The method of claim 1, further comprising the step of:

a) the one conductor surface is a first conductor surface;

b) providing the conductor with a second conductor surface that, when the second conductor surface contacts the first switch contact, displaces the first switch contact to the second displacement and out of contact with the second switch contact so as to open the circuit;

c) rotating the conductor about a longitudinal axis so as to align the second conductor surface to make contact with the first switch contact.

3. The method of claim 1 wherein:

a) the step of providing a conductor further comprises the step of providing the conductor with a free end that is flat;

b) the step of inserting the conductor partially into the port of the jack further comprises the step of inserting the conductor into the port of the jack until a resistance to further insertion is felt, wherein the flat free end contacts the first surface contact;

c) the step of rotating the conductor about a longitudinal axis further comprises the step of rotating the conductor until the resistance to further insertion lessens.

4. The method of claim 1 wherein the circuit is a digital circuit.

5. A plug for insertion into a jack, the jack having a set of normally closed contacts therein, comprising:

a) a sleeve having an outside diameter, the outside diameter being formed by a sleeve radius, the sleeve being structured and arranged to be received by a port in the jack, the sleeve having an end;

b) a conductor that extends from the end of the sleeve, the conductor having a free end and a sleeve end, with the sleeve end of the conductor being connected to the sleeve, the conductor having a length, the conductor being offset from a longitudinal axis of the sleeve so as to form a notch that extends from the free end along the length of the conductor toward the sleeve end.

6. The plug of claim 4 wherein the free end of the conductor is flat and intersects with the notch.

7. An apparatus for connecting to a circuit, comprising:

a) a jack, the jack having a port and comprising first and second switch contacts that are normally closed together so as to provide continuity of the circuit in the jack, the first switch contact being displaceable to first and second displacements relative to the second switch contact, with the circuit being closed when the first switch contact is displaced to the first displacement due to the first switch contact being in contact with the second switch contact, and with the circuit being opened when the first switch contact is displaced to the second displacement due to the first switch contact bring out of contact with the second switch contact;

b) a plug comprising a sleeve for being received by the jack port, the plug also comprising a conductor extending from the sleeve, the plug conductor comprises a first surface, the first surface having a first radius with respect to a longitudinal axis of the sleeve, the first surface extending from a free end of the conductor toward the sleeve, wherein when the first surface contacts the first switch contact, circuit continuity through the first and second switch contacts is maintained during the insertion of the plug conductor into the jack port.

8. The apparatus of claim 7 wherein the plug conductor comprises a second surface that has a second radius with respect to the longitudinal axis of the sleeve, wherein the second surface contacts the first switch contact, the first switch contact is displaced out of contact with the second switch contact, thereby opening the circuit.

9. The apparatus of claim 7 wherein the conductor is semicylindrical in shape.

10. The apparatus of claim 7 wherein the free end of the conductor is flat and intersects with the first surface.

11. The apparatus of claim 7 wherein the plug comprises a nonconductive handle located adjacent to the sleeve such that the sleeve is interposed between the handle and the conductor, the conductor rotating about the longitudinal axis with respect to the handle.

12. The apparatus of claim 7 wherein the circuit that the first and second switch contacts provide continuity for is a digital circuit.

13. The apparatus of claim 7 wherein;

a) the circuit in the jack is a first circuit, the jack also comprising a second circuit which has continuity provided by normally closed third and fourth switch contacts, the second circuit being opened by displacing the third switch contact out of contact with the fourth switch contact;

b) the plug conductor is a first conductor, the plug also comprising a second conductor that is insulated from the first conductor and that extends from the sleeve, the second conductor comprises a second surface, the second surface having a second radius with respect to the longitudinal axis of the sleeve, wherein when the second surface contacts the third switch contact, circuit continuity through the third and fourth switch contacts is maintained.

14. The apparatus of claim 13 wherein the first switch contact is displaced in a first direction when being displaced so as to open the first circuit, the third switch contact is displaced in a second direction when being displaced so as to open the second circuit, the second direction being different from the first direction.

* * * * *